US009280142B2

(12) United States Patent
Imamura et al.

(10) Patent No.: US 9,280,142 B2
(45) Date of Patent: Mar. 8, 2016

(54) RADIO CLOCK

(71) Applicant: SEIKO CLOCK INC., Tokyo (JP)

(72) Inventors: Miyuki Imamura, Tokyo (JP); Motohiro Tako, Tokyo (JP); Takayuki Kanaizumi, Tokyo (JP)

(73) Assignee: SEIKO CLOCK INC., Tokyo (JP)

( * ) Notice: Subject to any disclaimer, the term of this patent is extended or adjusted under 35 U.S.C. 154(b) by 0 days.

(21) Appl. No.: 14/313,136

(22) Filed: Jun. 24, 2014

(65) Prior Publication Data

US 2015/0003211 A1 Jan. 1, 2015

(30) Foreign Application Priority Data

Jun. 26, 2013 (JP) ..... 2013-134228

(51) Int. Cl.
*G04R 20/04* (2013.01)

(52) U.S. Cl.
CPC ..... *G04R 20/04* (2013.01)

(58) Field of Classification Search
CPC ..... G04R 20/02; G04R 20/04
USPC ..... 368/47
See application file for complete search history.

(56) References Cited

U.S. PATENT DOCUMENTS

| | | | | |
|---|---|---|---|---|
| 7,616,153 | B2 * | 11/2009 | Honda et al. | 342/357.74 |
| 7,649,812 | B2 * | 1/2010 | Baba | 368/47 |
| 7,715,279 | B2 * | 5/2010 | Urano et al. | 368/47 |
| 8,077,550 | B2 * | 12/2011 | Akiyama | 368/21 |
| 2008/0025151 | A1 * | 1/2008 | Urano et al. | 368/14 |
| 2008/0025156 | A1 * | 1/2008 | Urano et al. | 368/185 |
| 2008/0030403 | A1 * | 2/2008 | Honda et al. | 342/357.01 |
| 2008/0175105 | A1 * | 7/2008 | Urano et al. | 368/47 |
| 2009/0180356 | A1 * | 7/2009 | Fujisawa | 368/47 |
| 2011/0051559 | A1 * | 3/2011 | Oh | 368/10 |
| 2011/0063952 | A1 * | 3/2011 | Baba | 368/47 |
| 2012/0170425 | A1 * | 7/2012 | Matsuzaki | 368/47 |

FOREIGN PATENT DOCUMENTS

| | | | |
|---|---|---|---|
| JP | 2003-258680 | A1 | 9/2003 |
| JP | 2006-349587 | A1 | 12/2006 |
| JP | 2008-32636 | A1 | 2/2008 |
| JP | 2011-122891 | A1 | 6/2011 |

* cited by examiner

*Primary Examiner* — Vit W Miska

(74) *Attorney, Agent, or Firm* — Kratz, Quintos & Hanson, LLP

(57) ABSTRACT

A radio clock including: an antenna configured to receive a satellite signals transmitted from a plurality of GPS satellites; a receiving unit configured to perform a receiving process to acquire information tram a satellite signal received by the antenna, the information being contained in the satellite signal; and a control unit configured to control the receiving unit to keep synchronized with the GPS satellite that has transmitted the satellite signal and control the receiving unit to receive a satellite signal containing date information for date correction when the information acquired by the receiving unit does not contain the date information.

4 Claims, 5 Drawing Sheets

FIG. 3

| FIRST MONTH | FIRST WEEK | LAST MONTH | LAST WEEK | VALIDITY/INVALIDITY SETTING INFORMATION |
|---|---|---|---|---|
| MARCH | WEEK 2 | NOVEMBER | WEEK 1 | VALID |

RADIO CLOCK

CROSS-REFERENCE TO RELATED APPLICATION

This application is based upon and claims priority to Japanese Patent Application No. 2013-134228 filed on Jun. 26, 2013, subject matter of this patent document is incorporated by reference herein in its entirety.

BACKGROUND (i) Technical Field

The present invention relates to radio clocks, (ii) Related Art

A satellite used in GPS (Global Positioning System) (hereinafter referred to as a GPS satellite) includes a clock such as an atomic clock having high accuracy, and a signal transmitted from the GPS satellite contains information about time that is measured by the clock. A radio clock receives a signal from a GPS satellite, and corrects the time of the internal clock based on the time information contained in the received signal, to display time with high accuracy (see Japanese Unexamined Patent Application Publication No. 2008-32636, for example).

A signal transmitted from a GPS satellite contains date information as well as time information. Time information is transmitted from a GPS satellite at intervals of six seconds, and date information is transmitted from the GPS satellite at intervals of 30 seconds. For example, when a user takes a radio clock to a place in a good reception environment such as a spot near a window, the radio clock receives time information and starts correcting displayed time. In some cases, the user wrongly believes that the reception has been successfully completed, and moves away from the window to a place in a poor reception environment. There are cases where a few minutes are required to detect the positions of the clock hands and adjust the displayed time. If the radio clock starts an operation to acquire date information transmitted from the GPS satellite after those processes, a long period of time might be required for acquiring the date information due to a decrease in receiving sensitivity in a poor reception environment.

SUMMARY

It is therefore an object to provide a radio clock suppressing acquisition of information sent from a GPS satellite from taking a long period of time.

According to an aspect of the present invention, there is provided a radio clock including: an antenna configured to receive satellite signals transmitted from a plurality of GPS satellites; a receiving unit configured to perform a receiving process to acquire information from a satellite signal received by the antenna, the information being contained in the satellite signal; and a control unit configured to control the receiving unit to keep synchronized with the GPS satellite that has transmitted the satellite signal and control the receiving unit to receive a satellite signal containing date information for date correction when the information acquired by the receiving unit does not contain the date information.

BRIEF DESCRIPTION OF THE DRAWINGS

FIG. 3 is a diagram showing an example of daylight-saving time setting information;

DETAILED DESCRIPTION

Figure 1:
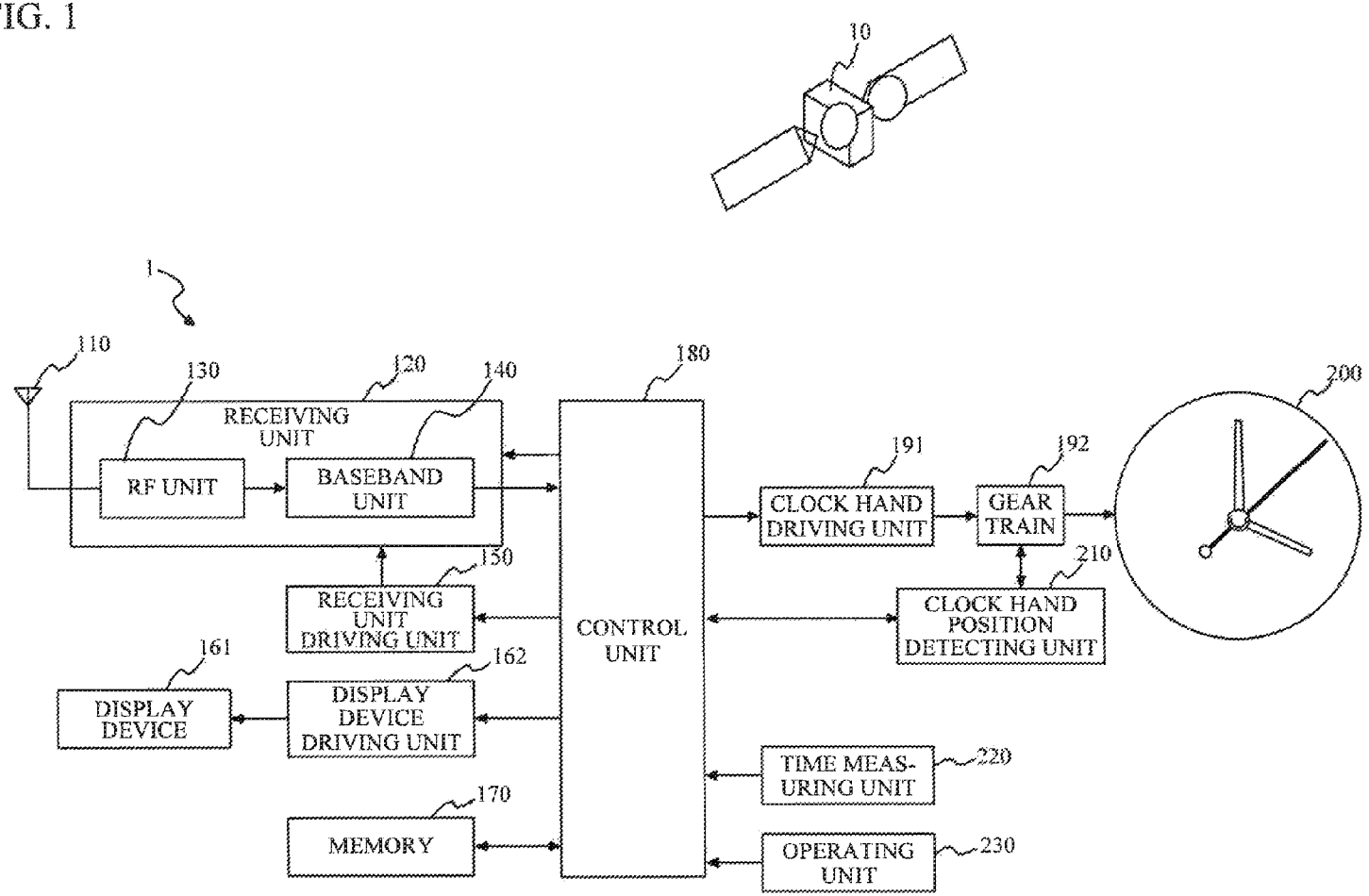
FIG. 1 is a diagram showing an example of the hardware of a radio clock.

Referring first to FIG. 1, the structure of this embodiment is described. A radio clock 1 of this embodiment includes a GPS antenna 110, a receiving unit 120, a receiving unit driving unit 150, a display device 161, a display device driving unit 162, a memory 170, a control unit 180, a clock hand driving unit 191, a gear train 192, a time display unit 200, a clock hand position detecting unit 210, an internal time measuring unit 220, and an operating unit 230.

The GPS antenna 110 is an antenna that receives satellite signals transmitted from GPS satellites 10. The GPS antenna 110 outputs the received satellite signals to the receiving unit 120. In FIG. 1, only one GPS satellite 10 is shown for simplicity.

The receiving unit 120 includes a RF (Radio Frequency) unit 130 and a baseband unit 140. The RF unit 130 and the baseband unit 140 perform a process to acquire information such as orbit information and time information from a navigation message superimposed on a satellite signal in a 1.5 GHz band transmitted from a GPS satellite 10.

Figure 2:
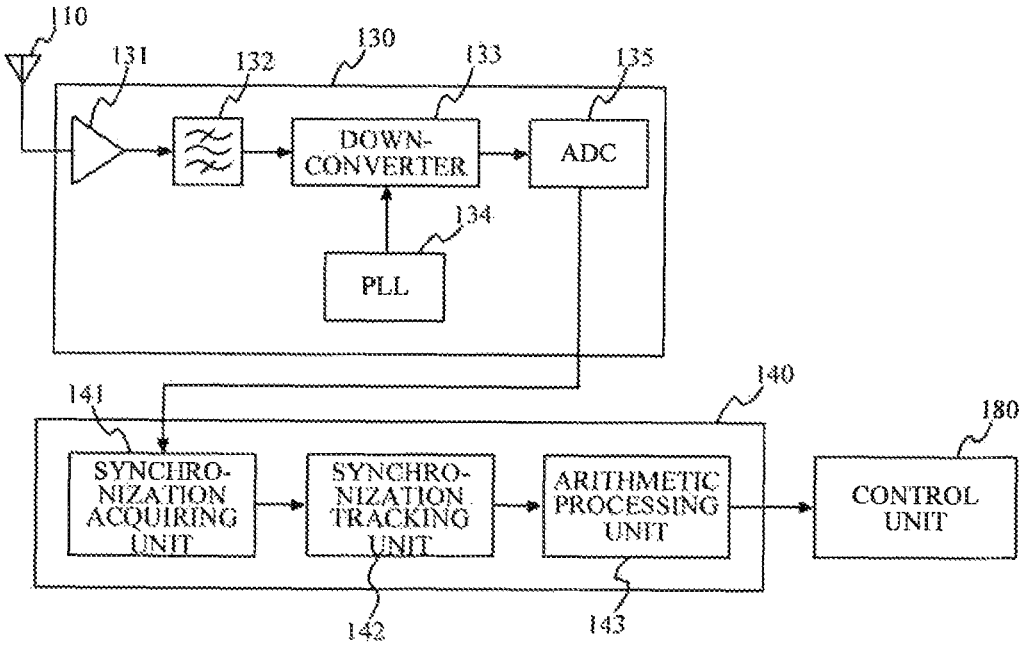
FIG. 2 is a diagram showing an example of the hardware of the receiving unit.

FIG. 2 shows example structures of the RF unit 130 and the baseband unit 140. The RF unit 130 includes a SAW (Surface Acoustic Wave) filter 131, an LNA (Low Noise Amplifier) 132, a down-converter 133, a PLL (Phase Locked Loop) circuit 134, and an ADC (A-D converter) 135.

The SAW filter 131 performs a process to extract a satellite signal from a signal received by the GPS antenna 110. That is, the SAW filter 131 is designed as a bandpass filter that passes 1.5-GHz band signals.

The LNA 132 amplifies the satellite signal extracted by the SAW filter 131. The satellite signal amplified by the LNA 132 is output to the down-converter 133.

The down-converter 133 is a circuit that converts the satellite signal into a signal at an intermediate frequency, and includes a mixer and a narrow bandpass filter, for example. The down-converter 133 down-converts the satellite signal output from the LNA 132 into a signal in an intermediate frequency band by mixing the satellite signal with a clock signal that is output from the PLL circuit 134. The output signal of the down-converter 133 is output to the ADC 135.

The PLL circuit 134 is a circuit that outputs a clock signal at a predetermined local frequency to the mixer of the down-converter 133 in synchronization with an output signal of an oscillator circuit (not shown), and includes a VCO (Voltage Controlled Oscillator), a prescaler, a phase comparator, and the like.

The ADC 135 converts the satellite signal output from the down-converter 133 into a digital value as digital data at a predetermined sampling frequency, and outputs the digital data to the baseband unit 140.

The baseband unit 140 includes a synchronization acquiring unit 141, a synchronization tracking unit 142, and an arithmetic processing unit 143. The baseband unit 140 demodulates a baseband signal from the digital signal (the signal in an intermediate frequency band) converted by the ADC 135 of the RF unit 130.

In the GPS system, the CDMA (Code Division Multiple Access) method by which all the GPS satellites 10 transmit satellite signals at the same frequency by using different C/A codes is used. The synchronization acquiring unit 141 acquires satellite signals by establishing phase synchronization among the C/A codes by using codes of the same PN series as the C/A codes being used by the GPS satellites 10 (the codes generated by the synchronization acquiring unit 141 being hereinafter referred to as local codes). Specifically, the synchronization acquiring unit 141 generates local codes having the same pattern as the C/A codes contained in baseband signals, and performs a process to achieve correlations between the C/A codes and the local codes. The synchronization acquiring unit 141 then adjusts the timings to generate the local codes so that the correlation value with respect to each of the local codes will be maximized. When a correlation value is equal to or larger than a threshold value, the synchronization acquiring unit 141 determines that synchronization with the GPS satellite 10 that has transmitted the corresponding local code is achieved.

The synchronization tracking unit 142 establishes correlations between baseband signals and local codes at the three timings: a timing earlier than a received signal, at the same time as the received signal, a timing later than the received signal. The correlations with those three timings are measured. If the correlation with the earlier timing is high, the reception timing is changed to an earlier timing. If the correlation with the later timing is high, the reception timing is changed to a later timing. In this manner, synchronization tracking is performed.

The arithmetic processing unit 143 demodulates navigation messages by mixing baseband signals with the local codes having the same, pattern as the C/A codes of the GPS satellites 10 acquired by the synchronization acquiring unit 141, and obtains information such as time information and date information contained in the navigation messages.

Under the control of the control unit 180, the receiving unit driving unit 150 causes the receiving unit 12G to operate, or causes the receiving unit 120 to stop operating.

The display device 161 is a device such as an LCD (a liquid crystal monitor), and displays information such as the date and the day of the week on a display unit. The display device driving unit 162 drives the display device 161 to display information on the display unit of the display device 161.

The memory 170 stores the program to be used by the control unit 180 to perform control, information received from the GPS satellites 10, daylight-saving time setting information, and the like. FIG. 3 shows an example of the daylight-saving time setting information. The daylight-saving time setting information contains information about the first month and the first week of daylight-saving time, information about the last month and the last, week of daylight-saving time, and information as to whether to make the daylight-saving time settings valid and as to whether to make the daylight-saving time settings invalid.

The control unit 180 controls the respective units in accordance with the program, recorded in the memory 170.

The clock hand driving unit 191 includes a step motor and the like (not shown). The clock hand driving unit 191 drives the gear train 192, and corrects the displayed time indicated by the clock hands (the hour hand, the minute hand, and the second hand) of the time display unit 200.

The clock hand position detecting unit 210 detects the position of the gear train 192, to detect the positions of the respective clock hands. A method of detecting the positions of clock hands with the clock hand position detecting unit 210 is disclosed in Japanese Unexamined Patent Application Publication No. 2011-122891, for example.

The time measuring unit 220 is a time measuring unit that measures the current time in the radio clock 1, and includes a year counter, a month counter, a day counter, an hour counter, a minute counter, and a second counter, for example.

The operating unit 230 receives an input of operation information such as alarm settings.

Figure 4:
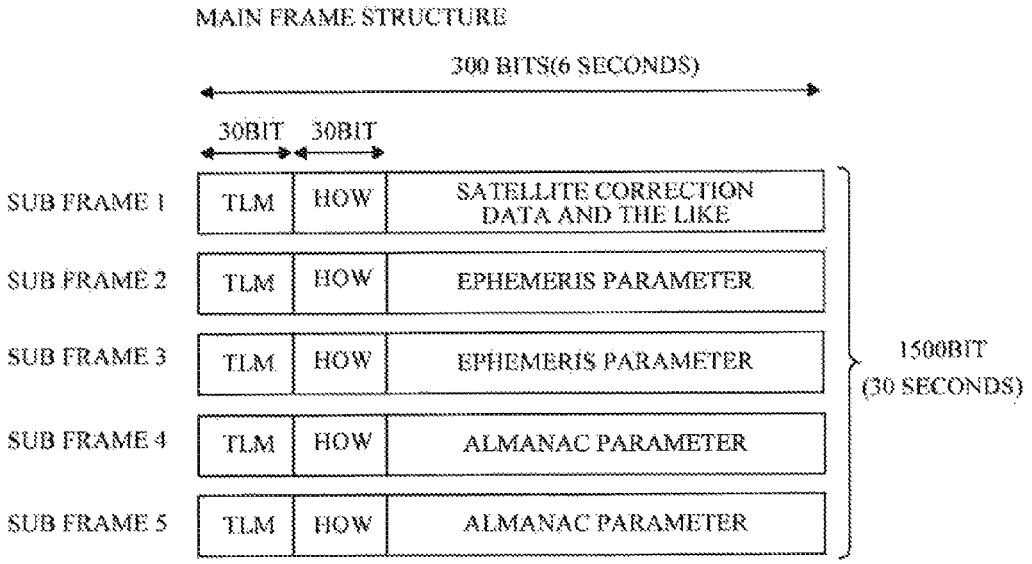
FIG. 4 is a diagram showing an example structure of a navigation message superimposed on a satellite signal.

Referring now to FIG. 4, a navigation message superimposed on a satellite signal transmitted from a GPS satellite 10 is described.

A navigation message is formed as data that has a main frame formed with a total of 1500 bits as one unit. The main frame is divided into five sub frames 1 through 5 each containing 300 bits. The data of one sub frame is transmitted from each GPS satellite 10 in six seconds. Accordingly, the data of one main frame is transmitted from a GPS satellite 10 in 30 seconds.

Sub frame 1 contains satellite correction data such as week number data (or date information). The week number data is information that indicates the week including the current time information. The starting point of GPS time information is 00:00:00, Jan. 6, 1980 in UTC (universal time coordinated), and the week number of the week starting from that date is 0. The week number data is updated on a weekly basis. Sub frames 2 and 3 contain ephemeris parameters (specific orbit information about the respective GPS satellites 10). Sub frames 4 and 5 contain almanac parameters (general orbit information about all the GPS satellites 10). Sub frames 1 through 5 each further contain a TLM (telemetry) word that stores TLM (telemetry word) data in the 30 bits from the top, and a HOW word that, stores 30-bit HOW (hand over word) data. Therefore, while the TLM word and the HOW word, or the time information, are transmitted from a GPS satellite 10 at intervals of 6 seconds, the week number data or the satellite correction data such as the date information is transmitted at intervals of 30 seconds.

In a case where a satellite signal received by the receiving unit 120 does not contain date data for date correction, or where the receiving unit 120 has received time information but has not received date information, the control unit 180 of this embodiment controls the receiving unit 120 to keep synchronized with the GPS satellite 10 from which the receiving unit 120 has received the time information. Specifically, the synchronization tracking unit 142 is made to use the same local code to achieve a correlation between the input baseband signal and the local code. While time information is transmitted from a GPS satellite 10 at intervals of 6 seconds, date information is transmitted at intervals of 30 seconds. Therefore, there are times when date information cannot be received immediately after reception of time information. In such a case, the receiving unit 120 is kept synchronized with the GPS satellite 10 from which the receiving unit 120 has received time information, so that a decrease in the receiving sensitivity of the receiving unit 120 at the time of reception of date information will be prevented. While the synchronization with the GPS satellite 10 is maintained, the receiving sensitivity is approximately 20 dBm higher than in a case where synchronization is not maintained (or at the time of synchronization acquisition). Accordingly, even if the user wrongly believes that the reception has been successfully completed, and moves away from the window to a place in a poor reception environment, the synchronization is maintained to prevent a decrease in the receiving sensitivity. Thus, the acquisition of date information can be prevented from taking a long period of time. As the acquisition of information is prevented from taking a long period of time, the power consumption of the radio clock can be reduced.

Particularly, in a case where the daylight-saving time settings are valid, the control unit 180 controls the receiving unit 120 to keep synchronized with the GPS satellite 10, and receive a satellite signal containing date information. In a case where the daylight-saving time settings are valid, and daylight-saving time has started, there are times when accurate time cannot be displayed before date information is received. Therefore, in a case where the daylight-saving time settings are valid, the receiving unit 120 is kept synchronized with the GPS satellite 10, so that the acquisition of the date information can be prevented from taking a long period of time, and the period from the start of the satellite signal reception to display of accurate time can be shortened.

In a case where the daylight-saving time settings are valid, the clock hand driving unit 190 adjusts the positions of the clock hands of the time display unit 200 after date information is acquired. Accordingly, in a case where the daylight-saving time settings are valid, and daylight-saving time has started, accurate time can be displayed.

Figure 5:
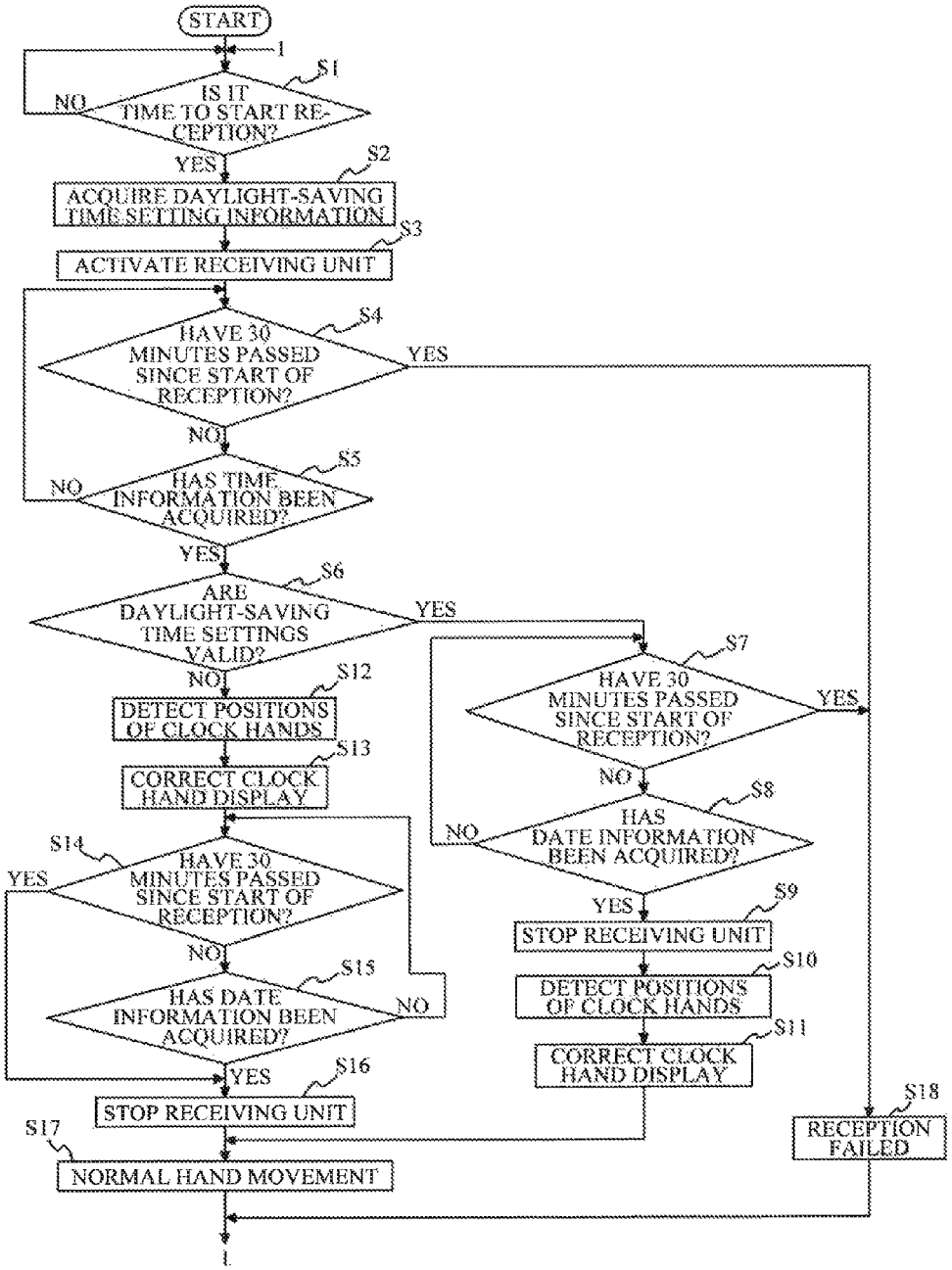
FIG. 5 is a flowchart showing the control procedures of the control unit.

Referring now to the flowchart shown in FIG. 5, the process flow of the control unit 180 is described.

When it is time to start reception of a satellite signal (step S1: YES), the control unit 180 first acquires the daylight-saving time setting information stored in the memory 170 (step S2). The control, unit 180 then controls the receiving unit driving unit 150 to activate the receiving unit 120 and cause the receiving unit 120 to start a satellite signal receiving operation (step S3).

The control unit 180 then determines whether 30 minutes have passed since the start of the satellite signal reception (step S4). If the result of the determination in step S4 is positive, the control unit 180 determines that the satellite signal reception has failed (step S18), and ends the process. If the result of the determination in step 34 is negative, the control unit 180 determines whether time information has been acquired (step 35). If the result of the determination in step S5 is negative, the control unit 180 returns to step S4, and repeats the procedures that follow. If the result of the determination in step S5 is positive, the control unit 180 refers to the daylight-saving time setting information acquired in step S2, and determines whether the daylight-saving time settings are valid (step S6). If the result of the determination in step S6 is positive, the control unit 180 determines whether 30 minutes have passed since the start of the satellite signal reception (step S7). If the result of the determination in step S7 is positive, the control unit 180 determines that the satellite signal reception has failed (step S18), and ends the process. If the result, of the determination in step S7 is negative, the control unit 180 determines whether date information has been acquired (step S3). In a case where the daylight-saving time settings are valid, the synchronization tracking unit 142 continues to receive satellite signals with the use of the same local code from the time when the receiving unit 120 starts reception in step S3 until the time when the date information is received in step S8 and the receiving unit 120 is stopped in step S9. That is, reception of satellite signals from the same GPS satellite 10 is continued. Accordingly, decreases in the receiving sensitivity of the receiving unit 120 during the period from the reception of the time information to the reception of the date information can be prevented.

If the result of the determination in step S8 is positive, the control unit ISO stops the receiving unit 120 (step S9). The control unit 180 then controls the clock hand position detecting unit 210 to detect the positions of the clock hands (step S10), and controls the clock hand driving unit 191 to correct the display positions of the clock hands based on the received time information and date information (step S11).

If the result of the determination in step S6 is negative, the control unit 180 controls the clock hand position detecting unit 210 to detect the positions of the clock hands (step S12), and controls the clock hand driving unit 191 to correct the display positions of the clock hands based on the received time information (step S13).

The control unit 180 then determines whether 30 minutes have passed since the start of the satellite signal reception (step S14). If the result of the determination in step S14 is positive, the control unit 180 stops the receiving unit 120 (step S16), and moves the clock hands in a normal manner (step S17). If the result of the determination in step S14 is negative, the control unit 180 continues to acquire date information while continuing to correct the clock hand display (step S15). The control unit 180 then determines whether date information has been acquired (step S15). If the result of the determination in step S15 is affirmative, the control unit 180 stops the receiving unit 120 (step S16), and moves the clock, hands in a normal manner (step S17). If the result of the determination in step S15 is negative, the control unit 180 returns to step S14, and repeats the procedures that follow.

The above described embodiment is a preferred embodiment of the present invention. However, the present invention is not limited to the embodiment, and various changes and modifications may be made to it without departing from the scope of the invention.

What is claimed is:

1. A radio clock, comprising:

a display unit configured to display time;

an antenna configured to receive satellite signals transmitted from a plurality of GPS satellites;

a receiving unit configured to perform a receiving process to acquire information from a satellite signal received by the antenna, the information being contained in the satellite signal;

a time correcting unit configured to correct the time displayed by the displaying unit based on time information acquired from the satellite signal by the receiving unit; and a control unit controls the time correcting unit to correct the time displayed by the display unit, wherein the control unit determines whether or not date information for date correction contained in the information acquired by the receiving unit is acquired after acquisition of the time information, wherein, when it is determined that the date information is not acquired, the control unit configured to control the receiving unit to keep synchronized with the GPS satellite that has transmitted the satellite signal and control the receiving unit to receive a satellite signal containing the date information.

2. The radio clock of claim 1, further comprising:

wherein the control unit controls the time correcting unit to correct the time displayed by the display unit after acquisition of the date information.

3. The radio clock of claim 1, wherein, when daylight-saving time settings are to take effect, the control unit controls the receiving unit to keep synchronized with the GPS satellite that has transmitted the satellite signal, and controls the receiving unit to receive a satellite signal containing the date information.

4. The radio clock of claim 1, wherein, when daylight-saving time settings are to take effect, the control unit controls the time correcting unit to correct the time displayed by the display unit after acquisition of the date information, wherein when the daylight-saving time settings are not to take effect, the control unit controls the time correcting unit to correct the time displayed by the display unit before acquisition of the date information.

* * * * *